United States Patent [19]

Dyhr et al.

[11] 4,141,223

[45] Feb. 27, 1979

[54] ENCAPSULATED REFRIGERATOR

[75] Inventors: Jan Dyhr, Sonderborg; Ole J. Nissen, Augustenborg, both of Denmark

[73] Assignee: Danfoss A/S, Nordborg, Denmark

[21] Appl. No.: 849,111

[22] Filed: Nov. 7, 1977

[30] Foreign Application Priority Data

Nov. 8, 1976 [DE] Fed. Rep. of Germany ..... 2650936

[51] Int. Cl.[2] ..... F25B 1/02; F25B 31/00; B25B 43/02

[52] U.S. Cl. ..... 62/469; 62/471; 62/503

[58] Field of Search ..... 62/468, 469, 470, 471, 62/503

[56] References Cited

U.S. PATENT DOCUMENTS

| | | | |
|---|---|---|---|
| 2,074,323 | 3/1937 | Borgerd | 62/470 X |
| 2,597,243 | 5/1952 | Hubacker et al. | 62/469 |
| 2,813,404 | 11/1957 | Hirsch | 62/471 |
| 3,154,245 | 10/1964 | Roelsgaard | 62/469 X |
| 3,163,999 | 1/1965 | Ditzler et al. | 62/470 X |
| 4,057,979 | 11/1977 | Abell et al. | 62/469 |

*Primary Examiner*—Stephen J. Novosad
*Attorney, Agent, or Firm*—Wayne B. Easton

[57] ABSTRACT

The invention relates to an encapsulated refrigerator assembly of the type in which an integrated motor and compressor unit is resiliently mounted in a hermetically sealed casing or capsule. An oil sump at the bottom of the capsule is provided for lubricating oil. An externally disposed centrifugal separator with an oil collecting tank at the bottom thereof provides refrigerant in vapor form for the compressor and oil for the oil sump. The compressor has a main inlet for receiving refrigerant vapor from the separator and a throttled inlet for receiving refrigerant vapor which is present in the capsule and which entered entrained in the oil received from the separator. The capsule has a single port and two tubes extend from this single port to the separator. An outer tube provides fluid communication between the separator oil collecting tank and the interior of the capsule houses the motor and compressor unit. A second or inner tube inside the outer tube is spaced therefrom and provides fluid communication between separator vapor outlet and the inlet of the compressor. The throttled compressor inlet has a large enough throttling resistance relative to the characteristics of a liquid refrigerant so that no more than harmless small amounts of liquid refrigerant in the interior space of the capsule can pass through the throttled compressor inlet under the suction force of the compressor unit. The capsule interior may be considerably filled with liquid refrigerant in the as-delivered condition but the throttling feature referred to will prevent refrigerant in a liquid state from being sucked into the compressor inlet.

6 Claims, 1 Drawing Figure

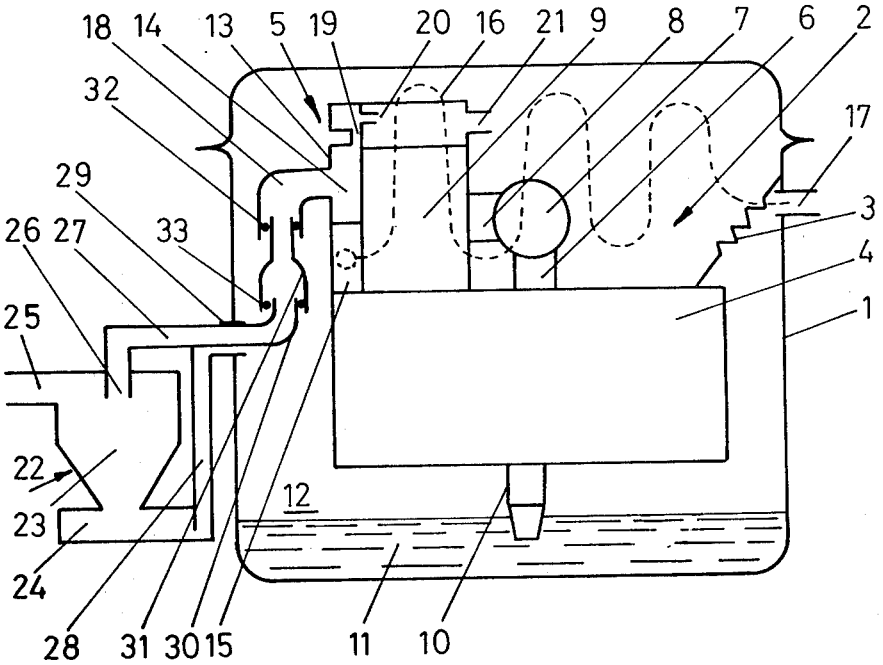
18
14
13
5
19
20
16
21
9
8
7
6
2
32
17
29
3
26
27
33
4
25
1
22
12
23
24
28
31
30
15
11
10

ENCAPSULATED REFRIGERATOR

The invention relates to an encapsulated refrigerator in which the capsule interior comprises an oil sump and is under suction pressure.

Such refrigerators have been used by the million for decades. The suction conduit coming from the refrigeration plant opens into the capsule interior. The refrigerant compressor sucks the refrigerant vapor out of the capsule interior.

When the capsule cools off after prolonged standstill periods, liquid refrigerant will condense in it. This condensate is partially absorbed by the oil and the other part remains as a liquid above the level of the oil. When the refrigerator starts, the refrigerant and oil are foamed up. If droplets of refrigerant are thereby sucked into the compressor, sudden pressure rises occur as a result of a sudden evaporation and these can lead to objectional sounds or even damage. It was therefore necessary to ensure that the condensation of refrigerant in the capsule was kept as small as possible or that the liquid refrigerant was evaporated before commencement of operation.

A refrigerator is also known in which the suction conduit extends from its passage through the capsule wall direct to the suction side of the refrigerant compressor so that suction gas which is as cold as possible reaches the compressor. This permits the compressor temperature to be reduced and the refrigeration effect increased. The capsule interior in this case communicates with the pressure side of the compressor, either by way of a gap between the piston and cylinder or by way of a downstream precooler in the compressor.

The invention is based on the problem of providing a refrigerator of the aforementioned kind in which the presence of liquid refrigerant in the capsule is harmless during starting of the compressor.

This problem is solved according to the invention in that the suction conduit extends from its passage through the capsule wall direct to the suction side of the compressor and the capsule interior is connected to this suction side by a throttle passage.

This construction is based on the consideration that the harmful foaming of oil and liquid refrigerant is caused by the fact that in the known refrigerators there is a sudden pressure drop in the capsule interior upon starting the compressor. According to the invention, the sudden pressure drop is effective only in the suction conduit so that the plant starts to operate normally. On the other hand, the pressure is reduced gradually in the capsule interior because of the throttle passage. With suitable adaptation of the throttling resistance to the operating data of the compressor, foaming can be prevented completely or at least reduced to an extent such that no harmful consequences occur. Further, the compressor motor has a lower starting torque because comparatively little refrigerant is sucked in; this is because there is little refrigerant vapour in the suction conduit and in the evaporator and the throttle passage acts towards the interior of the capsule.

Apart from this, one also obtains the advantage of refrigerators with direct connection of the suction conduit, namely the reduction in the compressor temperature and the increase in refrigeration effect, without their disadvantages concerning the oil circulation in the capsule and in the refrigeration plant. The amount of oil conveyed by the oil pump, particularly a centrifugal pump, depends inter alia on the interior capsule pressure acting on the surface of the oil. Hitherto this was dependent on the conveying pressure of the compressor that undergoes considerable fluctuations during operation. It is therefore not possible to set the oil circulation to a value that is best for lubrication and cooling. With excessive oil flow there is the additional danger that more oil reaches the refrigerant cycle, this leading to disruptive blockages. If, however, the interior of the capsule is under suction pressure which undergoes considerably fewer fluctuations during operation, an optimum circulation of oil can be set in the capsule and an unnecessary transfer of oil to the refrigerant cycle is prevented.

The throttle resistance of the throttle passage to the liquid refrigerant can be so large that no more than harmless small amounts of the liquid refrigerant can pass through under the suction force of the compressor. This dimensioning of the throttle passage ensures that liquid refrigerant can under no circumstances enter the compressor. If the throttle passage is blocked by liquid refrigerant, the pressure at the end of the liquid filament facing the compressor drops so that the boiling point drops at this location and the liquid filament is dissolved by gradual evaporation.

In the construction according to the invention it is not only immaterial how much refrigerant is condensed in the capsule but one can even intentionally fill the capsule with more liquid refrigerant. For example, the amount of liquid refrigerant required for the refrigeration plant can simply be introduced in the capsule. It is even possible to fill the capsule entirely or substantially with liquid refrigerant in the as-delivered condition in addition to the oil so that the capsule serves as a transport container. On installation, this capsule need merely be connected to the evacuated refrigeration plant and the compressor can then be started. This considerably simplifies the manufacture of refrigerator cabinets and the like.

The interior of the capsule can also communicate with the suction conduit in front of the suction side of the compressor and therefore be in shunt with the last suction conduit section. This offers the possibility of 'ventilating' the capsule interior at least temporarily with a small part stream of the suction gas, which prevents the formation of stagnant zones. This also facilitates pressure equalization after the compressor is switched off. If liquid has accumulated in the connecting conduit, it is pressed into the capsule on switching off of the compressor because the pressure in the suction conduit rises more rapidly than in the capsule.

With particular advantage a liquid separator is provided outside the capsule in the suction conduit and is connected to the capsule interior by a liquid withdrawal conduit. Such a liquid separator serves to separate oil and liquid refrigerant. During longer standstill periods there is considerable condensation of the refrigerant inside it. Since this liquid is returned to the capsule, the above-mentioned advantages also apply to this separated or condensed liquid refrigerant.

From a construction point of view it is very advantageous if the throttle passage opens into the suction valve chamber to which the suction conduit is also connected.

The invention will now be described in more detail with reference to an example shown in the drawing which diagrammatically illustrates a refrigerator according to the invention.

The FIGURE illustrates a capsule 1 in which a motor compressor 2 is suspended from springs 3. The motor compressor consists of an electric motor 4 and a piston compressor 5. By way of its shaft 6 and a crank slot 7, the motor reciprocates a compressor piston 8 in a cylinder 9. An oil conveying device 10 dips into an oil sump 11 which accumulates at the bottom of the interior 12 of the capsule 1.

A cylinder cover or head 13 comprises a suction valve chamber 14 and a pressure valve chamber 15 which communicate with the suction chamber of the compressor 5 by way of suction and pressure valves (not shown). The pressure valve chamber 15 is connected to a passage 17 by way of a winding pressure conduit 16 (shown in broken lines), it being possible to connect a condenser to the passage 17. The suction valve chamber 14 is on the one hand provided with a suction connector 18 and on the other hand communicates by way of a throttle passage 19 with at least one sound-damping chamber 20 which comprises an inlet connector 21 which opens into the interior 12 of the capsule.

A centrifugal separator 22 provided on the outside of the capsule 1 comprises a separating chamber 23 which has a vertical axis and is cylindrical at the top and conical at the bottom. At the bottom there is an adjoining collecting chamber 24 for liquid. At the top there is a tangential inlet connector 25 and a central immersion tube 26 which extends substantially above the height of the inlet cross-section. Leading to a passage 29 in the capsule wall, a suction gas passage 27 extends from the immersion tube and a liquid conduit 28 extends from the collecting chamber 24.

The gas passage 27 comprises a connector 30 disposed beneath the suction connector 18 of the compressor head 13. Both connectors are directed towards one another and extend substantially parallel to the axis of the motor compressor 2. Both connectors are telescopically surrounded by a substantially stiff connecting tube 31 which forms an articulation together with each connector by means of an O-sealing ring 32 or 33 serving as a damping element. By reason of these articulations, the motor compressor can move freely at its resilient suspension.

It is assumed that the refrigerator has been inoperative for a prolonged period, for example in winter. Consequently portion of the refrigerant from the entire installation has condensed in the capsule. If the compressor 2 is now switched on, it produces the full suction pressure in the suction valve chamber 14 and this becomes effective in the entire suction conduit, i.e. the suction gas passage 27, the connector 25 and the connecting conduit to the evaporator. The connection to the capsule interior 12, however, is effected through the throttle passage 19. The pressure drop occurring in this passage ensures that the pressure in the interior 12 does not immediately assume the value of the suction pressure that reaches this value only gradually. Consequently foaming of the liquid consisting of oil and refrigerant in the capsule 1 is entirely or substantially avoided. Since the boiling point of the refrigerant decreases with a drop in pressure, steadily more refrigerant is evaporated so that, when substantially the suction pressure has been reached in the capsule, practically all the refrigerant has been withdrawn in vapor form by way of the throttle passage 19 to the suction side of the compressor.

In operation, the interior communicates with the liquid separator 22 by way of the conduit 28. This provides a shunt flow path through which a small part stream of the suction gas is constantly passed through the capsule. If the level of liquid in the collecting chamber 24 rises above the inlet cross-section of the conduit 28, corresponding liquid particles are carried along by this part stream and led to the capsule. If a larger amount of liquid has formed in the liquid separator 22 during the standstill period this is likewise returned to the capsule interior as soon as there is an adequate pressure difference between the liquid collecting chamber and the capsule interior.

Instead of the illustrated centrifugal separator one can also use any other liquid separator, e.g. with baffle plates. The conduit 28 can also lead to the capsule interior at an incline.

We claim:

1. An encapsulated refrigerator assembly, comprising, a capsule having an oil sump at the bottom thereof, an integrated motor unit and compressor unit mounted in said capsule, said compressor unit having first and second compressor inlet means, port means in said capsule, fluid passage means between said port means and said first compressor inlet means, said second compressor inlet means having direct fluid communication with the interior space of said capsule, and throttle means for said second compressor inlet means.

2. A refrigerator assembly according to claim 1 wherein the throttling resistance of said throttle means relative to the characteristics of a liquid refrigerant is large so that no more than harmless small amounts of liquid refrigerant in said interior space of said capsule can pass through said second compressor inlet means under the suction force of said compressor unit.

3. A refrigerator assembly according to claim 2 wherein said capsule is considerably filled with liquid refrigerant in the as-delivered condition.

4. A refrigerator assembly according to claim 1 wherein said capsule interior space also communicates with said port means in shunt with said fluid passage means between said port means and said first compressor inlet means.

5. A refrigerator assembly according to claim 4 which includes a liquid separator outside said capsule, said separator having liquid conduit means connected to said port means and in fluid communication with said capsule interior space.

6. A refrigerator assembly according to claim 1 wherein a common chamber is provided for said first and second compressor inlet means.

* * * * *